United States Patent [19]

McCutchen et al.

[11] 4,211,629

[45] Jul. 8, 1980

[54] ANODE AND BASE ASSEMBLY FOR ELECTROLYTIC CELLS

[75] Inventors: Hugh L. McCutchen, Florence, Ala.; James W. Bess, Sr., Painesville, Ohio

[73] Assignee: Diamond Shamrock Corporation, Dallas, Tex.

[21] Appl. No.: 11,415

[22] Filed: Feb. 12, 1979

[51] Int. Cl.[2] ..... C25B 9/04; C25B 11/02; C25B 11/10

[52] U.S. Cl. ..... 204/252; 204/288; 204/289

[58] Field of Search ..... 204/252-258, 204/263-266, 286, 288-289

[56] References Cited

U.S. PATENT DOCUMENTS

| | | | |
|---|---|---|---|
| 3,719,578 | 3/1973 | Berthoux et al. | 204/252 |
| 3,836,438 | 9/1974 | Sartre et al. | 204/252 X |
| 3,891,531 | 6/1975 | Bouy et al. | 204/252 X |
| 3,928,167 | 12/1975 | Bouy et al. | 204/286 |
| 4,121,994 | 10/1978 | Crippen et al. | 204/286 |

*Primary Examiner*—John H. Mack
*Assistant Examiner*—D. R. Valentine
*Attorney, Agent, or Firm*—John P. Hazzard; Stephen A. Littlefield

[57] ABSTRACT

An improved anode and base assembly for diaphragm type electrolytic cells is disclosed. In the present embodiment, downwardly facing annular portions at the base of the anode risers of dimensionally stable anodes of the type well-known in the art are welded from below directly to a metal cell base cover which seals the electrolyte contained within the cell from the cell base which is generally of copper or aluminum, thereby eliminating corrosion problems associated with leaks in the rubber gaskets or blankets formally used between the anode risers and the cell base.

10 Claims, 6 Drawing Figures

ANODE AND BASE ASSEMBLY FOR ELECTROLYTIC CELLS

This invention relates to the art of electrolytic cells for the electrolysis of alkali metal halides to produce halogens, alkali metal hydroxides, alkali metal hypohalites, halates and the like, and, more particularly, to an anode-base assembly for diaphragm-type electrolytic cells utilizing a valve metal base cover to which the anode posts are welded to effect an hydraulic seal. Such sealing by welding eliminates the use of rubber gasketing to prevent cell leakage at the anode posts.

BACKGROUND OF THE INVENTION

The diaphragm-type electrolytic cell for the production of chlorine and caustic is one of the most common types of electrolytic cell currently in use for commercial production of these valuable chemicals. Generally, a diaphragm cell incorporates a plurality of parallel, vertically oriented anodes placed between parallel vertically oriented foraminous cathode tubes. The anodes utilized are generally of the dimensionally-stable type comprising a cylindrical anode riser made of titanium or titanium clad copper to which a pair of parallel foraminous titanium plates or screens are welded. Various designs of this dimensionally stable anode either place the screens in a fixed position relative to each other or allow movement of the screens toward and away from each other in parallel planes. The screens are generally made of a valve metal or alloy of a valve metal such as titanium and have applied thereto an electrocatalytic coating which lowers the discharge overpotential for chlorine produced in the electrolysis process and increases the lifetime of the anode in the highly corrosive environment of the anode compartment of an electrolytic cell. The electrocatalytic coatings are generally precious metals or oxides thereof or mixtures of nonprecious and precious metals and/or their oxides.

The cathode tubes generally comprise a foraminous structure which may be either a perforated plate, expanded metal mesh, or wire screening, with iron or steel being the most common material used for such cathode tubes.

A separator, which is generally applied to the exterior of the cathode tubes, is interposed between the anodes and cathodes. The separator may be a hydraulically permeable diaphragm comprising asbestos fibers or a mixture of asbestos and polymeric fiber materials, or the separator may comprise a hydraulically impermeable ion exchange membrane.

In a hypochlorite cell or a chlorate cell, no separator is used in a cell which is otherwise of substantially the same configuration as the above-described diaphragm cell.

The cathode tubes are generally connected at their side edges to a conductive cathode can, the can forming a four-sided box which is open at both the top and the bottom thereof. In the assembly of the electrolytic cell, the cathode can is lowered over the anode cell base which has the anodes vertically position thereon, and a sealing gasket is provided between the edges of the cathode can and the cell base to prevent electrical shorting of the components. A brine head cover atop the cathode can completes the cell assembly.

A typical cell base and anode assembly is generally described in U.S. Pat. No. 3,591,483 and U.S. Pat. No. 3,707,454, both to Loftfield et al. The cell bases as described by Loftfield et al, comprise an electroconductive base portion which may be of copper, aluminum, or iron having a series of holes drilled therein for accepting extended base portions of the anode risers and attaching such risers to the cell base. A nonconductive sheet of rubber or passivated titanium is placed over the conductive cell base which electrically insulates the cell base and seals the base from the brine electrolyte so as to prevent corrosion of the base by the brine contained within the cell. In a manner similar to the cell base, the base cover has a series of holes extending therethrough which correspond to the holes of the cell base for allowing the passage of the anode posts therethrough to the cell base. A flange may be provided which is located on the anode riser and above a threaded portion of the anode riser which attaches the riser to the cell base rests on the cell base cover. When a rubber cell base cover is used, compression of the cell base cover with the attachment of the anode riser to the cell base creates a compression seal between the flange and the cell base cover which prevents leakage of brine around posts.

As used in this specification, the term "passivated" as applied to valve metals in general and titanium in particular, will be understood to mean an electrolytically inactive surface coating of oxide which is formed on the surface of the valve metal. Most commonly, a passivated surface is formed almost immediately in situ by the action of electrolyte on the exposed surface of valve metals. Other methods of passivating a valve metal surface may also be used.

In the case of a passivated titanium cell base cover, it was necessary, as taught by the above-mentioned Loftfield et al, patent, that a compressible rubber gasket was required between the flange portion of the anode riser and a titanium cell base cover so that proper sealing could be effected.

It has been found over the years of utilizing the cell base and anode structure described above, that rubber components such as a rubber cell base cover or rubber gaskets surrounding the anode flange when titanium cell base covers were used, would deteriorate and cause a leakage of brine through to the cell base and result in substantial corrosion of both the anode risers and the cell base. During cell operations, rubber gasketing material is attacked by all of the very corrosive chemicals within the electrolyte such as chlorine, sodium hypochlorite, sodium chlorate, oxygen and sodium chloride with this corrosive attack being accelerated by high temperatures within the cell which can exceed 200° F. Such attack necessitates frequent replacement of rubber parts within the anode base assembly thus requiring the complete disassembly of the electrolytic cell including the removal of anodes from the base. Should any of such rubber parts fail during operation, there is a consequent massive attack by the electrolyte on the metal components of the cell base.

Lifetimes of electrocatalytically coated anodes within a diaphragm-type electrolytic cell may be as much as ten years in the current state of the art. However, the need for frequent renewal of rubber parts within the anode base assembly, requires a much more frequent disassembly of the cell than would be necessary for the replacement of coated anodes. A sealing arrangement which would eliminate the use of rubber materials and the consequent required regular replacement thereof, would be desirable in that the anode base assembly would not have to be disassembled for any reason for a period of up to or more than ten years.

Many early and current cell designs avoid any leakage problem with the conductive base by providing a valve metal base cover which is completely integral, that is having no holes therein and welding connector plates, generally having an L-form to the side of the base cover facing the interior of the cell. Assemblies of this type are described in U.S. Pat. Nos. 3,956,097 and 4,118,306 and British patent specifications Nos. 1,125,493 and 1,127,484. The difficulty with these types of anode base assemblies is that there is considerable electrical resistance between the conductive cell base through the titanium base cover to the anodes themselves. The passage of current through the titanium base cover offers substantial resistance to the flow of anodic current. Also, it is necessary that good contact be maintained between the titanium base cover and the conductive cell base. This must be accomplished by the use of extremely clean, flat surfaces on the facing portions of the cell base and the base cover. The difficulties with this procedure are apparent.

One means for overcoming the difficulty of passing current from a cell base through an integral cell base cover to the anodes has been overcome by the use of perforated cell base covers with extended portions of the anodes passing through the perforations so that direct contact may be made with the conductive cell base. This reduces the electrical resistance of the system, but it creates the problem of keeping the highly corrosive electrolyte away from the cell base and the conductive extended portions of the anode posts. Electrolyte corrosion quickly destroys the cell base and creates a leakage problem requiring extensive repair or replacement of cell components.

While rubber gasketing offers a temporary solution to this problem, as noted above, it is still necessary to disassemble the cells on a regular basis to replace rubber gasketing materials which degrade during the operation of the cell. A more permanent and noncorrosive seal would be helpful.

Buoy et al, in U.S. Pat. No. 3,928,167 and related Pat. No. 3,891,531 describe a welded seal around anode posts passing through a perforated cell base cover made of titanium. The method involved welding a cup-shaped disk of titanium to a portion of the anode post so as to create an outwardly extending flange having an upwardly standing ring portion located at the outer edge of the flange. The titanium cell base cover has an enlarged perforation therein having a similar upstanding ring portion associated with the edge of the perforation. The diameter of the cup-shaped flange is approximately that of the perforation so that when the anode post is inserted into the cell base, the ring portions of the flange and the perforation are in alignment adjacent to each other and final sealing is effected by welding the two ring portions together circumferentially around the top of the perforation. While this method eliminates the use of rubber gasketing materials to create a seal between the electrolyte and the cell base around the perforation in the titanium cell base cover, at least two problems of assembly are created by this method. First of all, alignment of the perforations with the connecting holes in the cell base is absolutely essential so that the rings of the flange and cell base will come into proper alignment when the anode post is installed. There is little or no room for adjustment. The second difficulty is that when anode posts having screens attached thereto are utilized, the efficacy of welding along the top of the cell base cover and the flange portion of the cup-shaped disk becomes very difficult due to the space limitations imposed by the anode screens and adjacent anodes.

Crippen et al, U.S. Pat. No. 4,121,994, offers another solution to the sealing of anode posts to a titanium cell base cover. This patent discloses the use of a titanium washer which is welded to the anode post so as to create a flange in a manner similar to that described in Buoy et al. When the anode post is inserted into the cell base for electrical connection, the flange then rests on top of the perforated titanium cell base cover. The edges of the titanium washer-flange are then welded to the top of the perforated titanium cell base cover to create an impermeable seal around the base of the anode and the perforated cell base cover. Since there is no necessary alignment of upstanding ring portions of the apparatus as in Buoy et al, the problems of alignment are avoided. However, since the washer-flange is welded to the top of the titanium cell base cover, there is still the problem similar to that of Buoy et al of spacial interference between the anode screens and adjoining anodes which precludes the use of automatic welding equipment which could greatly facilitate the installation of anodes and guarantee uniformity of welding and sealing.

Additional problems associated with welding of anode posts to a metal cell base cover include the development of stresses with the uneven heating of the materials during welding and during cell operation when there can be an expansion or contraction of cell components. Such expansions and contractions can cause cracking in both the welds and various cell components, such cracking leading to leaks of electrolyte which can cause corrosion of cell components.

It is therefore a principal object of this invention to eliminate the use of degradable rubber components in the anode and base assembly for diaphragm-type electrolytic cells.

It is a further object of this invention to provide an anode and base assembly which can be assembled utilizing automatic welding equipment.

It is a further object of this invention to provide an electrolytic cell having a perforated cell base cover and direct attachment of anode posts to a conductive cell base wherein critical alignment of the anode posts with perforations in the perforated cell base cover are not critical and sealing around the base of the anode posts is effected by welding the anodes to the metallic cell base cover.

It is yet another object of this invention to provide a welded titanium cell base cover in which anode posts are welded to the cover with connecting portions of the anode posts passing therethrough which is uneffected by heating distortions caused by both welding and by high temperature cell operation.

These and other objects of the invention will become apparent to those skilled in the art upon the reading and understanding of the drawings and specification presented hereinafter.

SUMMARY OF THE INVENTION

In accordance with the invention, a cell base and anode assembly comprises an electrically conductive cell base having anode post receiving holes disposed therein, a titanium cell base cover having perforations which generally correspond to the holes in the electrically conductive cell base disposed therein, a plurality of dimensionally stable anodes having anode risers and connecting posts disposed on the lower ends thereof, fastening means connecting the connecting posts to the cell base, a generally downwardly facing annular surface disposed above the connecting posts along the anode risers and a weld bead extending between the titanium cell base cover and the annular surface around each of the anode posts.

Further in accordance with the invention, the titanium cell base cover as above described incorporates at least one raised ridge circumscribing the mounting holes above described.

In accordance with the invention, a generally cylindrical anode riser is utilized having anode screens attached thereto. The anode riser has projecting from the base thereof and coaxial therewith, a mounting stud or connecting post which stud or connecting post is utilized in establishing mechanical and electrical connection with the conductive cell base. The connecting post has a diameter which is substantially smaller than the diameter of the anode riser. An annular surface extends between the bottom of the anode riser and the top of the projecting portion of the connecting post, such annular surface having an outside diameter equal to that of the anode riser and an inner diameter equal to that of the connecting post. As utilized in this specification, the term "annular surface" will be understood to include both a planar surface which is perpendicular to the axis of the anode riser and connecting post and having a surface configuration generally similar to a washer and also a conical or tapered surface extending between the outward edge of the anode riser diameter and the connecting post. The anode riser is positioned so that the connecting post passes through a perforation in a valve metal cell base cover, such perforation having a diameter which is less than that of the anode riser but equal to or preferably larger than the diameter of the connecting post. The annular surface rests on the top or inside portion of the valve metal cell base cover. A weld bead extends between the edge of the perforation and the annular surface of the anode to create a mechanical bond between the cell base cover and the anode riser as well as effecting a hydraulic seal around the base of the anode. The assembly is installed on a conductive cell base, and the connecting posts are secured to the conductive cell base by any manner common in the art.

As utilited in this specification, the term "titanium cell base cover" or "valve metal cell base cover" will be understood to include the valve metals themselves or alloy modifications of titanium or other valve metals such as tantalum, niobium, vanadium, zirconium, or any other metals common for such usage in the art.

In accordance with the invention, the cell base cover is generally planar in form. However, indentations, ridges, ribs, or grooves may be formed in the cover adjacent the perforations, such discontinuities in the surface offering a means for absorbing distortion developed by heating either through the welding process or cell operation so that such distortions do not put an undue stress on the totality of the cell base cover which may cause cracking thereof.

BRIEF DESCRIPTION OF THE DRAWINGS

The invention is illustrated in the attached drawings showing a preferred embodiment of the invention including specific parts and arrangements of parts. It is intended that the drawings be included as a part of this specification and be illustrative of a preferred embodiment of the invention only and should in no way be considered a limitation on the scope of the invention itself.

DETAILED DESCRIPTION OF THE PREFERRED EMBODIMENTS AND DRAWINGS

The invention will now be described in the more limited aspects of preferred embodiments thereof including specific parts and arrangements of parts. It will be understood by those skilled in the art that variations and deviations from the description and illustrations of the invention are possible, and such deviations and variations are to be included within the scope of the appended claims.

Figure 1:
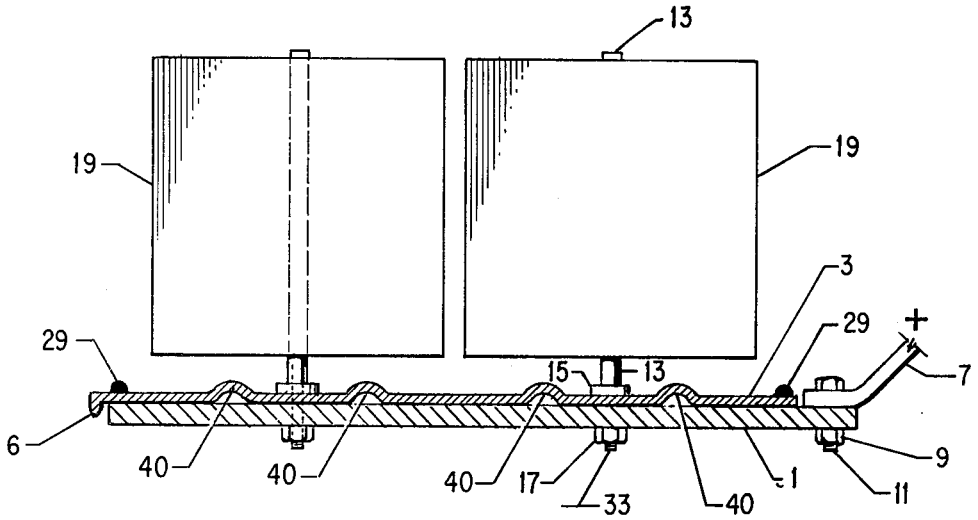
FIG. 1 is a simplified end view of a typical diaphragm-type electrolytic cell base and anode assembly applying the improved construction and advantages of the present invention with the cathode can and cathodes removed for clarity.
Figure 2:
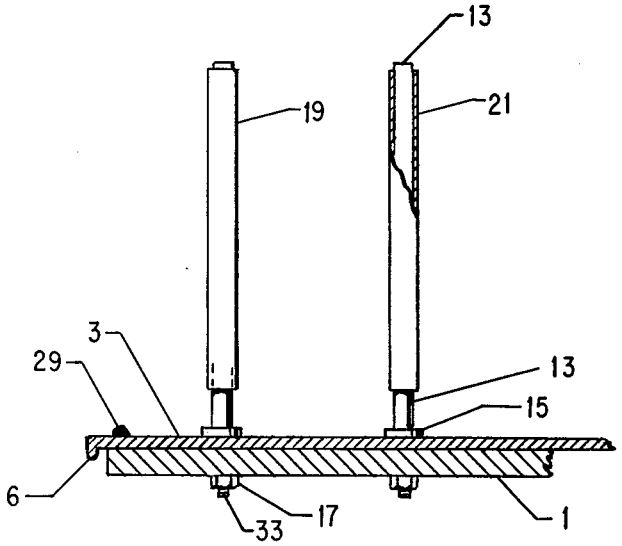
FIG. 2 is a simplified side view of the cell shown in FIG. 1.

Referring now to the drawings wherein the showings are for the purposes of illustration and not limitation and in which corresponding elements in the different figures have the same numbers, FIG. 1 is an end view of a typical anode and cell base assembly according to the present invention. For purposes of clarity, the conventional cell can comprising a plurality of vertically-oriented, parallel cathode tubes enclosed within an electroconductive four-sided box is not shown. In the figures, the cell base 1 is constructed of a material such as aluminum, iron or copper and serves as both the supporting means for the cell and as a conductor of anodic current. The power supply conductor 7 is attached directly to the cell base 1, for example, by means of a nut 9 and bolt 11. In practice, power supply conductor 7 may lead to a source of direct current or may be connected to the cathode portion of an adjacent electrolytic cell as is common in a multiple-cell operation such as a production cell room. A titanium cell base cover 3 which is essentially nonconductive in the cell environment covers substantially all of the cell base 1. For the purposes of clarity, the relative thickness of the cell base cover has been exaggerated. It will be understood that the cover is preferably as thin as possible to conserve expensive material. The practical lower limit or thickness of the cell base cover is that which can be readily welded, generally about 0.040 inches or less. A small amount of putty 29 lines the edge of cell base cover 3 to insure that no leakage occurs when the cathode can is installed. A resilient frame-form gasket may also be used instead of putty 29. Protrusion 6 serves as a deflector to prevent brine or water from getting between the cell base 1 and the cell base cover 3. Anode screens 19 are connected as by welding to anode riser 13, which riser has a connecting post 33 having a diameter smaller than that of anode riser 13 which extends through the titanium cell base cover 3 and the cell base 1 by extending through perforations 30 and 32 in the cell base cover 3 and the cell base 1, respectively, and is fastened on the bottom of the cell base by a connector means such as nut 17. Anode riser 13 may be provided with a flange 15 having a downwardly facing annular surface 34 which annular surface 34 rests on top of titanium cell base cover 3.

Figure 3:
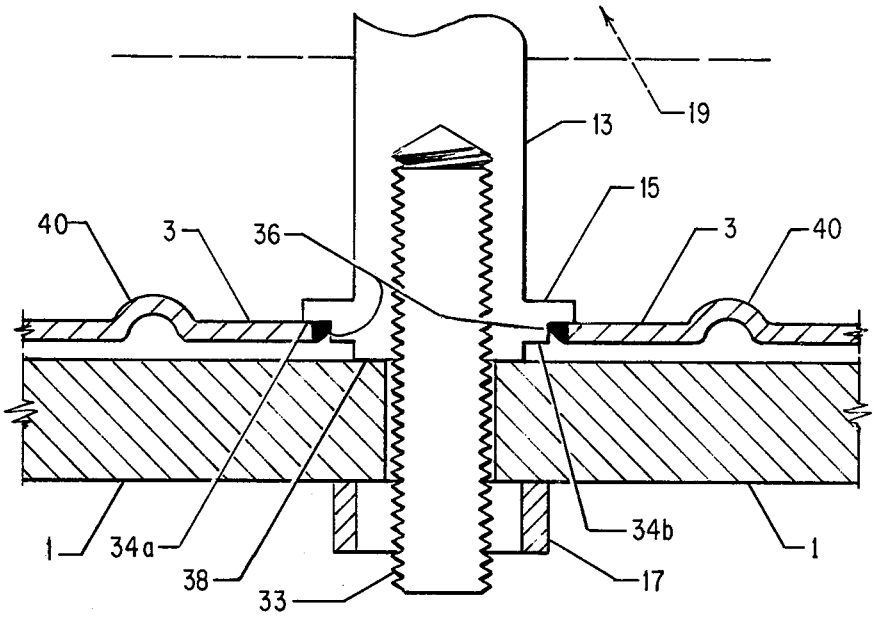
FIG. 3 is a simplified view of one form of the anode connection portions of the assembly in accordance with the invention showing the anode riser and the cell base and various other components of the assembly illustrating a preferred embodiment of the invention.

As best shown in FIG. 3, anode riser 13 is vertically oriented with respect to cell base 1 and cell base cover 3. Circular flange 15 having annular surface 34 rests on cell base cover 3 and extends over perforation 30 therein. As shown in FIG. 3, annular surface 34 has a stepped configuration, that is, it comprises two annular surfaces 34*a* and 34*b*, the diameter of surface 34*b* being smaller than that of 34*a*. It will be understood, however, that this stepped configuration is merely preferred and no step need be provided. Weld bead 36 is laid down continuously around the circumference of hole 30 in cell base cover 3 along the lower face 34*a* of flange portion 15 and creates a unitary structure between anode riser 13 and cell base cover 3 while also creating an hydraulic seal around the base of anode riser 13 so that electrolyte contained within the cell will not leak around the anode riser 13 or flange 15 so that it comes into contact with cell base 1 and causes corrosion thereof.

Figure 4:
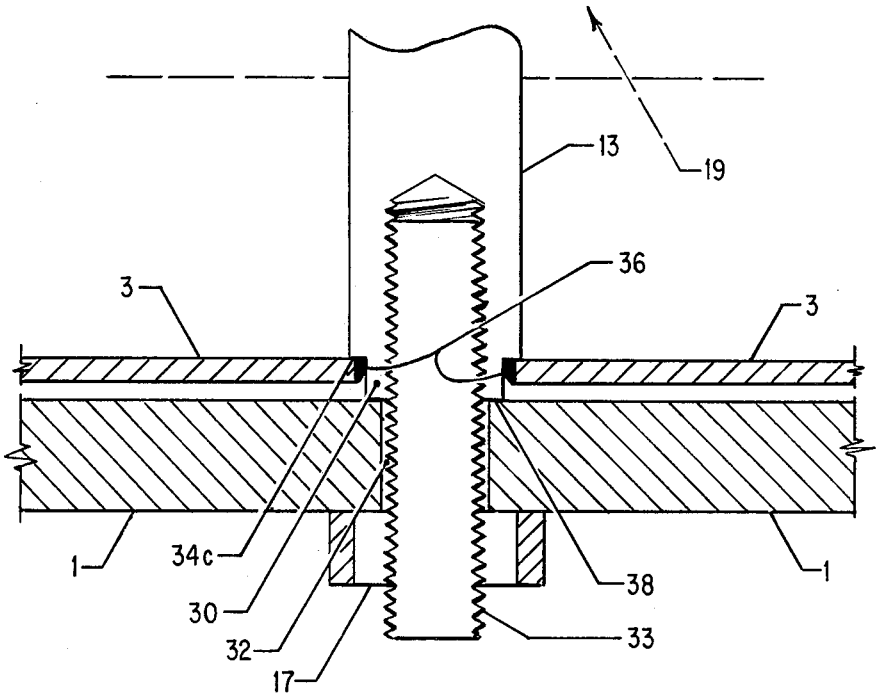
FIGS. 4 and 5 are views similar to that of FIG. 3 showing alternative forms of anode connection.
Figure 5:
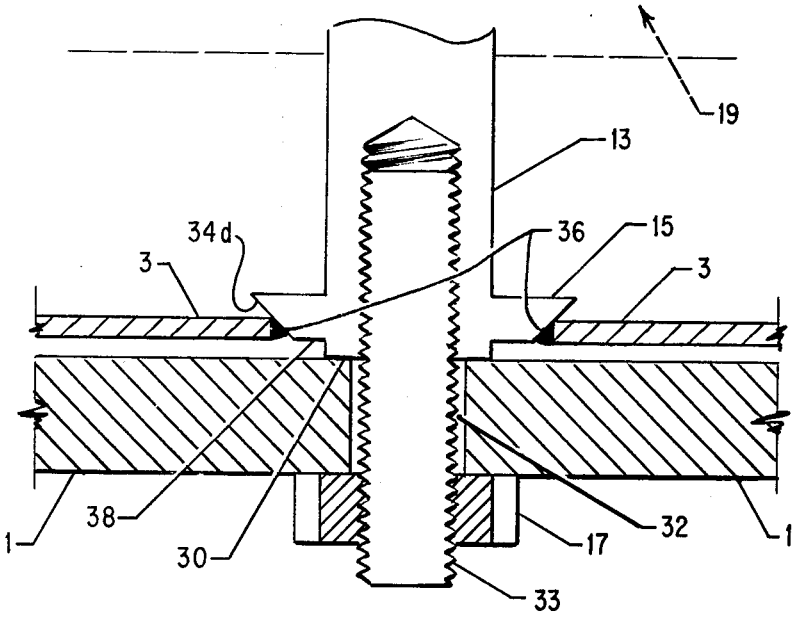

As seen in FIGS. 3–5, a portion of anode riser 15 extends somewhat below annular surface 34 and rests in abutment on conductive cell base 1 at annular surface 38 to establish electrical connection therewith. The contact is maintained by nut 17 on connecting post 33. Thus, depending on the thickness of cell base cover 3, such cell base cover 3 may, in fact, be "floating" above the cell base 1 or may be in contact therewith.

Other embodiments of the invention similar to that shown in FIG. 3 are clearly illustrated in FIGS. 4 and 5. While the embodiment shown in FIG. 3 illustrates an anode post 13 having a flange 15 located at the base thereof, such a flange is not necessary. Anode post 13 may end in a downwardly facing annular surface 34*c* as illustrated in FIG. 4. Annular surface 34*c* must be covered with titanium of a thickness sufficient for welding. Perforation 30 in titanium cell base cover 3 is of a diameter which is smaller than that of the anode riser 13 so that annular surface 34*c* which is generally perpendicular to the axis of anode riser 13 rests on the upper surface of titanium cell base cover 3. In a manner similar to that shown in the embodiment of FIG. 3, weld bead 36 is laid down circumferentially around perforation 30 and extends to the downwardly facing annular surface 34*c* of anode riser 13.

Similarly, FIG. 5 illustrates an anode riser having a tapered flange portion so that a conical annular surface 34*d*, again of titanium of sufficient thickness, is created and faces the top surface of titanium cell base cover 3. This embodiment of the invention is preferred since it permits point contact of the flange 15 at conical annular surface 34*d* thereby avoiding the presence of crevices which may lead to points of corrosion. In a manner similar to the other embodiments shown, weld bead 36 extends between the circumference of perforation 30 in titanium cell base cover 3 to annular surface 34*d* thereby to create an hydraulic seal around the base of anode riser 13.

FIGS. 3 through 5 illustrate, in phantom, the presence of anode screens 19 located immediately above the connecting portions of anode riser 13. It can be seen that welding of the anode riser to the titanium cell base cover 3 from the top or inside portion of the cell would be difficult, at best, due to the spacial limitation of the anode screens and adjacent mounted anodes. In accordance with the invention, anode risers 13 having anode screens 19 attached thereto and connecting post 33 located therein are positioned so that connecting post 33 extends through perforation 30 in titanium cell base cover 3 and downwardly facing annular surface 34*a*, 34*c*, 34*d* contacts the top or inside portion of perforation 30. The portion of annular surface 34*a*, 34*c*, 34*d* located inside perforation 30 is accessible from below so that weld bead 36 may be laid down between the inside edge of perforation 30 and annular surface 34*a*, 34*c*, 34*d*. Following the welding of all of the anodes in a manner similar to that described, the conductive cell base is then installed on the connecting posts 33 with portions 38 in abutment against conductive cell base 1 or, conversely, the cell base cover 3 with anodes attached is installed on conductive cell base 1, and the anodes are secured by nuts 17.

Weld bead 36 is applied by any welding process common in the art of welding titanium such as laser welding, arc welding or resistance welding but arc welding with an inert gas flush both above and below titanium cell base cover 3 is preferred.

Figure 6:
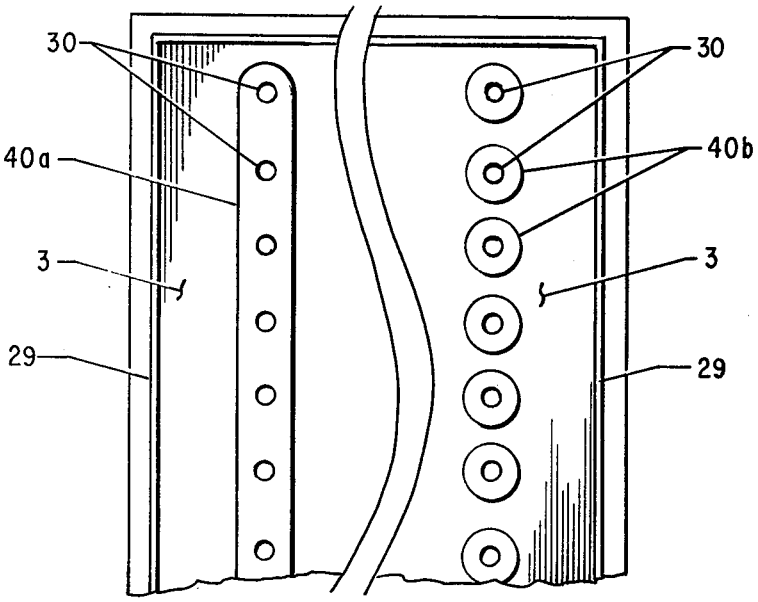
FIG. 6 is a top plan view of one preferred form of titanium cell base cover used in accordance with a preferred embodiment of the invention.

As particularly shown in FIGS. 3 and 6, cell base cover 3 may incorporate protrusions 40 adjacent hole 30 and spaced therefrom. It will be understood that such protrusions are only preferred and are not necessary for the implementation of the invention. The purpose of the protrusions 40 is to prevent distortion of the titanium cell base cover 3 out of its flat, planar configuration during the welding process which attaches the lower face 37 of necked-down flange portion 34 to the sides of hole 30. Protrusions 40 also act to absorb distortions of cell components due to expansion and contraction of such cell components during cell operations in which temperatures may fluctuate.

As shown in FIG. 6, protrusions 40 may extend circumferentially around a plurality of holes 30 on cell base 3 as shown by part 40*a* of FIG. 4 or may extend circumferentially around each hole 30 as shown at 40*b* of FIG. 4. Again it will be understood that such protrusions are merely preferred to avoid welding distortion of cell base cover 3 and are not necessary if welding distortion can be avoided in some other way. Protrusions 40 may take other forms such as a bellows or z-shape form or any other form which allows stress relief within the cell base cover 3.

While the invention has been described with reference to certain specific embodiments thereof, other embodiments of the invention have been implied, and still others will occur to those skilled in the art upon the reading and understanding of the foregoing specification. It is intended that all such embodiments be included within the scope of the appended claims.

What is claimed is:

1. In an electrolytic cell for the electrolysis of alkali metal halide solutions of the type comprising an anode and cell base assembly and a cathode cell can, the improvement in the anode and cell base assembly which comprises:

(a) A conducting and supporting cell base means having perforations disposed therein for receipt of anode risers;

(b) A substantially electrically nonconductive metal cell base cover having an outer surface and an inner surface facing said cell base, said cell base cover covering the entire upper surface of said cell base, having perforations disposed therein corresponding to said perforations in said cell base;

(c) Dimensionally stable anodes, each of said anodes comprising an electrically conductive surface, a material supporting said electrically conductive surface and an anode riser having a downwardly facing annular surface on the lower portion thereof at least a portion of said annular surface in contact with said outer surface of said cell base cover and a connecting post extending past said annular surface and through said perforations in said metal cell base cover and said cell base, and (d) A circumferential weld bead extending between each said annular surface and the periphery of each said perforation in said cell base cover, whereby said flange, anode riser and metal cell base cover comprise a unitary structure and a hydraulically impermeable seal is created between each said annular surface and said metal cell base cover by said weld bead.

2. A cell base assembly as described in claim 1 wherein each said annular surface is conical in form.

3. A cell base assembly as described in claims 1 or 2 wherein said metal cell base cover further includes a protrusion extending circumferentially around and spaced from at least one of said perforations in said cell base cover.

4. A cell base assembly as described in claim 3 wherein said protrusion extends circumferentially around a plurality of said holes in said metal cell base cover which holes are in alignment on said cell base.

5. A cell base assembly as described in claim 1 wherein said anode riser further includes an outwardly extending flange and said annular surface is located on the bottom of said flange.

6. A cell base assembly as described in claim 1 wherein said metal cell base cover is made of titanium.

7. A cell base assembly as described in claim 1 wherein said metal cell base cover is made of a titanium alloy.

8. In a method for assembly of an electrolytic cell having a perforated metal cell base cover having a plurality of perforations therein and anode having anode risers and connecting portions attached thereto passing through said perforations and a downwardly facing annular surface extending between the base of said anode risers and said connecting posts, the method comprising the steps of:

(a) Inserting said connecting posts through said perforations in said metal cell base cover;

(b) Positioning said anode risers so that said annular surface is in contact with the top surface of said metal cell base cover;

(c) Welding edge portions of said perforation to said downwardly facing annular surface from the underside of said metal cell base cover, and (d) Attaching said connecting posts to a conductive cell base.

9. In an electrolytic cell for the electrolysis of alkali metal halide solutions of the type comprising an anode and cell base assembly and a cathode cell can, the improvement in the anode and cell base assembly which comprises:

(a) A conducting and supporting cell base means having perforations disposed therein for receipt of anode risers;

(b) A substantially electrically nonconductive metal cell base cover covering the entire cell base, having perforations disposed therein corresponding to said perforations in said cell base;

(c) A protrusion extending circumferentially around and spaced from at least one of said perforations in said cell base cover;

(d) Dimensionally stable anodes, each of said anodes comprising an electrically conductive surface, a material supporting said electrically conductive surface and an anode riser having a downwardly facing annular surface on the lower portion thereof and a connecting post extending past said annular surface and through said perforations in said metal cell base cover and said cell base, and (e) A circumferential weld bead extending between said annular surface and said titanium cell base cover within each said perforation in said metal cell base cover, whereby said flange, anode riser and metal cell base cover comprise a unitary structure and a hydraulically impermeable seal is created between each said annular surface and said metal cell base cover.

10. A cell base assembly as described in claim 9 wherein said protrusion extends circumferentially around a plurality of said holes in said metal cell base cover which holes are in alignment on said cell base.

* * * * *